United States Patent [19]

Giordani

[11] Patent Number: 4,924,069

[45] Date of Patent: May 8, 1990

[54] HOT WATER SUPPLY FOR TUBS

[75] Inventor: Attilio G. Giordani, Simi Valley, Calif.

[73] Assignee: Teledyne Industries, Inc., Los Angeles, Calif.

[21] Appl. No.: 122,766

[22] Filed: Nov. 19, 1987

[51] Int. Cl.[5] ..... F24H 1/16

[52] U.S. Cl. ..... 219/306; 219/336; 4/493; 4/545

[58] Field of Search ..... 4/493, 544, 545, 542, 4/492, 504, 506, 541, 543, 584; 219/296, 327, 335, 336, 301, 306, 307, 316, 318, 319, 296, 327, 335, 336; 137/341

[56] References Cited

U.S. PATENT DOCUMENTS

| | | | |
|---|---|---|---|
| 1,571,379 | 2/1926 | Sharpe | 219/306 |
| 1,807,951 | 6/1931 | Ahern | 219/299 |
| 2,266,216 | 12/1941 | Kimberlin | 219/318 |
| 2,574,929 | 11/1951 | McClain | 219/306 |
| 2,712,590 | 7/1955 | Doble | 219/336 |
| 3,446,938 | 5/1969 | Morgan | 219/336 |
| 3,571,818 | 3/1971 | Jacuzzi | 4/545 |
| 3,809,073 | 5/1974 | Baumann | 4/542 |
| 4,052,757 | 10/1977 | Dotson | 4/493 |
| 4,057,372 | 11/1977 | Johnson et al. | 4/542 |
| 4,169,293 | 10/1979 | Weaver | 4/544 |
| 4,185,187 | 1/1980 | Rogers | 219/306 |
| 4,208,570 | 6/1980 | Rynard | 219/306 |
| 4,233,694 | 11/1980 | Janosko et al. | 4/509 |
| 4,240,166 | 12/1980 | Altman et al. | 4/492 |
| 4,330,412 | 5/1982 | Frederick | 4/492 |
| 4,339,833 | 7/1982 | Mandell | 4/492 |
| 4,529,033 | 7/1985 | Blum | 4/493 |
| 4,563,571 | 1/1986 | Koga et al. | 219/299 |
| 4,593,177 | 6/1986 | Trostler | 219/328 |
| 4,594,500 | 7/1986 | Wright | 4/493 X |
| 4,595,825 | 6/1986 | Gordbegli | 219/306 |
| 4,638,147 | 1/1987 | Dytch et al. | 219/308 |
| 4,660,545 | 4/1987 | Ely | 4/493 |
| 4,742,456 | 5/1988 | Kamena | 4/542 |

OTHER PUBLICATIONS

C&R Specialties—"Model 40-5100" (including horizontal pump arrangement)–*Spa and Sauna* Aug., Jul., 84 p. 103.

Applied Computer Controls Inc. (note heater and control arrangement) *Spa and Sauna* Jan. 88 p. 83.

Ramco "Hurracane" (note heater and control arrangement) *Spa and Sauna* Jan. 88 p. 73.

Brett Aqualine Inc. advertisement—p. 140 Spaand Sauna Trade Journal Feb. 1984 vol. 9 No. 2.

German Offenlegungsschrift 3534754 2/4/87 see FIGS. 1–3.

1987 Brochure The Answer Pak, by HydroQuip Spa Systems.

Spa and Sauna, "The Voice of the Hot Water Industry" Feb. 1987.

*Primary Examiner*—Henry J. Recla
*Assistant Examiner*—Edward C. Donovan
*Attorney, Agent, or Firm*—Benoit Law Corporation

[57] ABSTRACT

Tubs are supplied with hot water through a water circulation system including a pump, an elongate electric flow-through heater, a water filter and piping connecting that pump, elongate flow-through heater and water filter in series in that water circulation system. The pump, elongate flow-through heater and piping are arranged in a horizontal plane so that water flow passages in that piping, in the elongate flow-through heater and in the pump are intersected by that horizontal plane extending along directions of water flow in the mentioned water flow passages. The pump may be provided with a water inlet and a water outlet both lying in the same horizontal plane as the elongate flow-through heater and piping. The pump also may be provided with an axis of rotation, and even with an electric drive motor, extending in that horizontal plane. The elongate flow-through heater may be provided with an elongate structure molded of an electrically insulating synthetic resin for housing an electric heating element. A metal plate is sealed to that elongate housing structure at a lateral opening thereof in parallel to the above mentioned horizontal plane, as both a base for the electric heating element and as an electrically conductive complement of the electrically insulating housing structure.

12 Claims, 3 Drawing Sheets

HOT WATER SUPPLY FOR TUBS

BACKGROUND OF THE INVENTION

1. Field of the Invention

The subject invention relates to spa and hot tub systems, including jetted tubs, and to hot water supply and circulation systems therefor.

INFORMATION DISCLOSURE STATEMENT

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

Also, no preamble of any statement of invention or claim hereof is intended to represent that the content of that preamble is prior art, particularly where one or more recitations in a preamble serve the purpose or providing antecedents for the remainder of a statement of invention or claim.

U.S. Pat. No. 1,807,951, by W. A. Ahern, issued June 2, 1931, proposed a water heater in which a helical electric heater element was encompassed by a pair of radially spaced cylindrical shells defining a thin annular flow-through chamber. The throughput was relatively small in that type of heater.

U.S. Pat. No. 2,574,929, by J. R. McClain, issued Nov. 13, 1951, disclosed an electric automobile water heater which displayed a better throughput. However, the electric heating element was rendered inaccessible for replacement by rigid interconnection of the two housing halves.

U.S. Pat. No. 4,185,187, by D. H. Rogers, issued Jan. 22, 1980, disclosed an electric water heating apparatus for swimming pools, spas and hydrotherapy equipment. A vertical synthetic resin shell encompassed an inner housing assembly composed of three axially distributed sleeves of synthetic material containing a cantilevered electric heating element and a thermostat, and conducting water from a horizontal inlet to a horizontal outlet. In that kind of a structure, a cantilevered heating element is subject to stress flexture and fatigue failure. Also, it is not seen how an all-plastic electrically insulating structure could comply with the generally required fault current collection.

U.S. Pat. No. 4,563,571, by R. Koga et al, issued Jan. 7, 1986, discloses an electric flow-through water heater having an outer shell encompassing a hollow-cylindrical water flow path and a partially coaxial inner ceramic heater through which water leaves the flow path. Koga et al further encourage strong turbulence in the water flow path.

U.S. Pat. No. 4,594,500, by M. J. Wright, issued June 10, 1986, discloses an electrically heated pump for spas and swimming pools, in which the electric heating element is uniquely disposed inside the pump outlet chamber around the suction inlet of the impeller. In practice, this would appear to require a partial dismantling of the pump for a replacement of the heating element.

U.S. Pat. No. 4,595,825, by M. Gordbegli, issued June 17, 1986, discloses a vertical heater with angular inlet and outlet bosses, which houses an electric heating element and consists of a heat and electrically conductive metal or metal alloy with embedded thermostat. The cantilevered heating element seems to be subject to stress flexture and fatigue. While fault current collection is good around the entire metal housing, heat losses would appear to be high as well.

U.S. Pat. No. 4,593,177, by R. M. Trostler, issued June 3, 1986, discloses a tubular brass body enclosing a water flow-through path with electric heater in a reduced differential, high limit thermostat system. Heat from the water flows through the highly conductive brass body to a thermal insulator plate acting as a thermal summing network, and thence through a copper heat conductor plate to a high limit thermostat. Again, heat losses through the tubular brass body would appear to be considerable.

U.S. Pat. No. 4,638,147, by A. Dytch et al, issued Jan. 20, 1987, discloses a microprocessor-controlled flow-through electric water heater. A cannister, made preferably of copper, houses controlled electric heating elements and provides a water flow-through path. The water inlet and outlet are at and near the bottom, respectively, of the essentially vertical copper cannister.

A recent brochure by HYDRO QUIP SPA SYSTEMS, of Santa Ana, Calif. 92701, discloses portable spa-type hot water supply equipment including a so-called cast aluminum straight-through manifold serving also as a fault current collector.

Certain complexities and convolutions in layout and piping could not be avoided with existing designs and approaches. This may, for instance, be seen from the February 1987 issue of *Spa and Sauna,* "THE VOICE OF THE HOT WATER INDUSTRY," including an advertisement and illustration by Premier Pump & Pool Products, Inc., and Premier Industries of Canada, an illustration by California Acrylic Industries, an advertisement and illustration by Baker Hydro, Inc., an advertisement and illustration by Pacific Industries Inc., an advertisement and illustration by Baja of Tucson, Ariz.

Even those among these proposals which had a simpler pipe outlay required pumping aginst gravity or induced other losses in a vertical direction between pump and heater and/or heater and filter inlet.

SUMMARY OF THE INVENTION

It is a general object of this invention to overcome the disadvantages and to meet the needs expressed or implicit in the above Information Disclosure Statement or in other parts hereof.

It is a germane object of this invention to provide improved methods and apparatus for supplying tubs with hot water through improved water circulation and heating systems.

It is a related object of this invention to improve the design and rheology of water circulation and heating systems for hot water tubs.

It is also an object of this invention to provide electric flow-through water heaters combining essential fault current conduction with the toughness and corrosion resistance of plastic bodies.

It is a related object of this invention to provide equipment for injecting air bubbles into hot water tubs with improved anti-syphon valving.

Other objects of the invention will become apparent in the futher course of this disclosure.

From a first aspect thereof, the subject invention resides in a method of providing a water circulation system including a pump, an elongate electric flow-through heater, a water filter and piping connecting that pump, elongate flow-through heater and water filter in series in the water circulation system for supplying a tub having a bottom with hot water. The invention according to this aspect resides, more specifically, in the improvement comprising, in combination, the steps of arranging the pump, elongate flow-through heater and piping in a horizontal plane so that water flow passages in that piping, in the elongate flow-through heater and in the pump are intersected by the horizontal plane extending along directions of water flow in the water flow passages and arranging the horizontal plane below the bottom of the tub.

From a related aspect thereof, the invention resides in a system for supplying a tub having a bottom with hot water through a water circulation system including a pump, an elongate electric flow-through heater, a water filter and piping connecting that pump, elongate flow-through heater and water filter in series in the water circulation system. The invention according to this aspect resides, more specifically, in the improvement comprising, in combination, means for mounting the pump, elongate flow-through heater and piping in a horizontal plane located below the bottom of the tub so that water flow passages in that piping, in the elongate flow-through heater and in the pump are intersected by the horizontal plane extending along directions of water flow in the water flow passages.

From another aspect thereof, the invention resides in a system for injecting air bubbles into water located in a tub through air piping and, more specifically, resides in the improvement comprising, in combination, an air blower having an air outlet connected to the air piping, and an anti-syphon valve in that air blower ahead of the air outlet connected to the air piping.

The air blower preferably includes an outlet chamber ahead of the air outlet connected to the air piping, and means for positioning the anti-syphon valve inside of that outlet chamber.

Other aspects of the invention are apparent from the remainder of this disclosure, and no restriction to any aspect, object, or feature, as intended by this Summary of the Invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
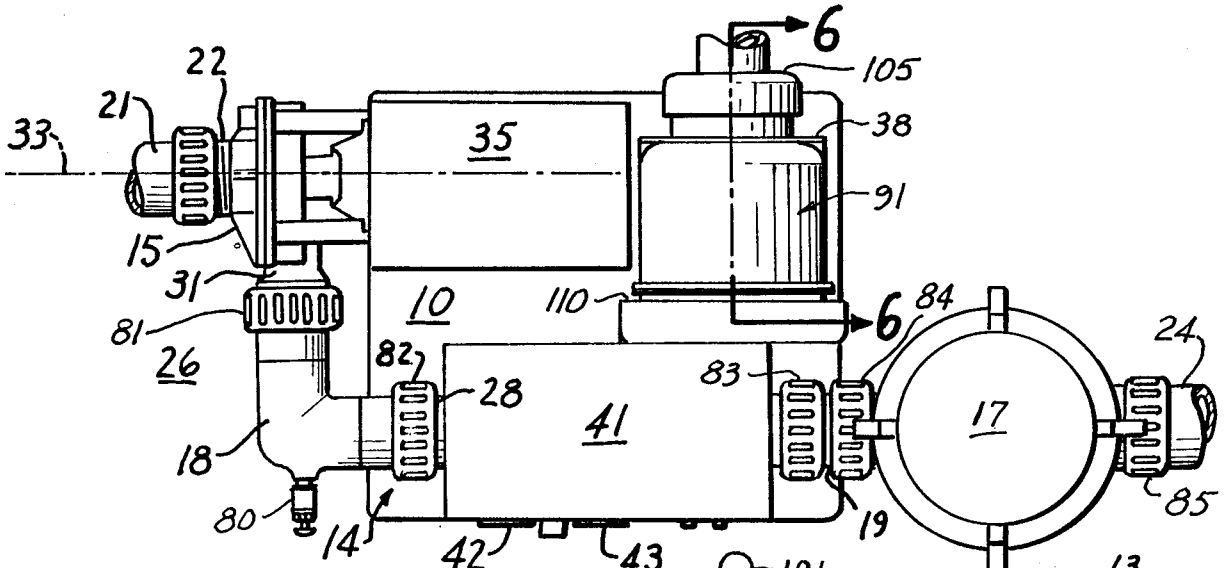
FIG. 1 is a plan view of a spa equipment assembly according to a preferred embodiment of the subject invention.

The illustrated equipment or unit 10 has the main purpose of supplying a tub 12 with hot water 13 through a water circulation system 14, including a pump 15, an elongate electric flow-through heater 16, a water filter 17 and piping 18 and 19 connecting that pump, elongate flow-through heater and water filter in series in that water circulation system 14.

The tub 12 may, for instance, be the shell of a pool or of a spa. In the latter case, equipment of the type shown at 10 sometimes is referred to as spa equipment assembly.

Those skilled in the art will, of course, recognize a certain disparity in size between the illustration of the unit 10 and the tub 12. In reality, the tub 12 typically, if not always, is much larger in size than the unit 10. In fact, such a unit 10 typically is sufficiently small and compact to be readily accommodated in the skirt (not shown) of the spa at the tub.

The water circulation system 14 has a water return line 21, typically leading from the bottom of the tub to an inlet 22 of the pump 15, and a water feedline 23 leading from an outlet of the filter 17 to the tub 12. Typically, water jets may be provided in the wall of the tub 12 for delivering the water pumped through the feedline 23.

According to the currently disclosed aspect of the subject invention, the pump 15, elongate flow-through heater 16 and piping 18 and 19 are arranged in a horizontal plane 26 so that water flow passages in such piping, in the elongate flow-through heater 16 and in the pump 15 are intersected by that horizontal plane extending along directions of water flow in such water flow passages.

Due to such arrangement in a horizontal plane 26, water remains in the unit even if the pool or tub itself is drained or suffers from a lack of water. In this manner, the pump 15 is self-priming, which enables use of pump designs and types which normally would not start properly without an infusion of water, generally known as "priming the pump."

Moreover, the illustrated preferred horizontal arrangement of the flow-through heater 16 in the plane 26 preserves the presence of water in the heater which reduces the danger of overheating or of hot external surfaces, which may occur, if the heater were arranged vertically so that water would readily drain therefrom by force of gravity.

Figure 2:
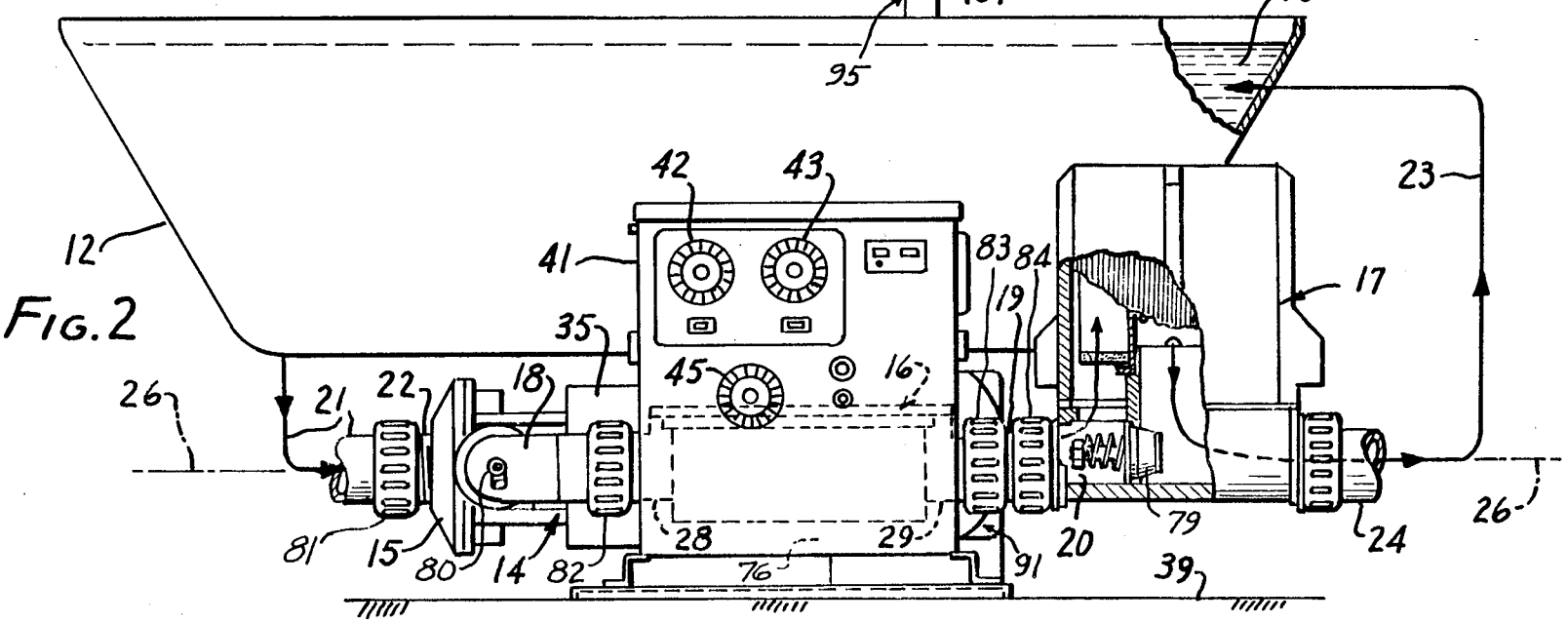
FIG. 2 is an elevation of the assembly shown in FIG. 1 and of a spa or similar tub on a reduced scale.
Figure 4:
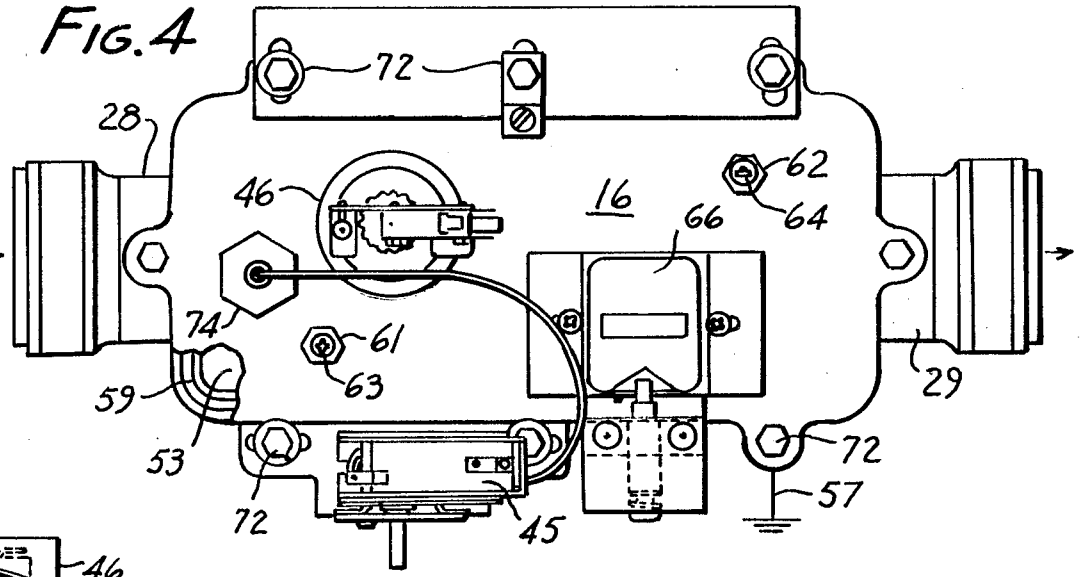
FIG. 4 is a top view, on an enlarged scale, of an electric heater according to an embodiment of the invention, which may be used in the spa equipment assembly of FIGS. 1 to 3.
Figure 5:
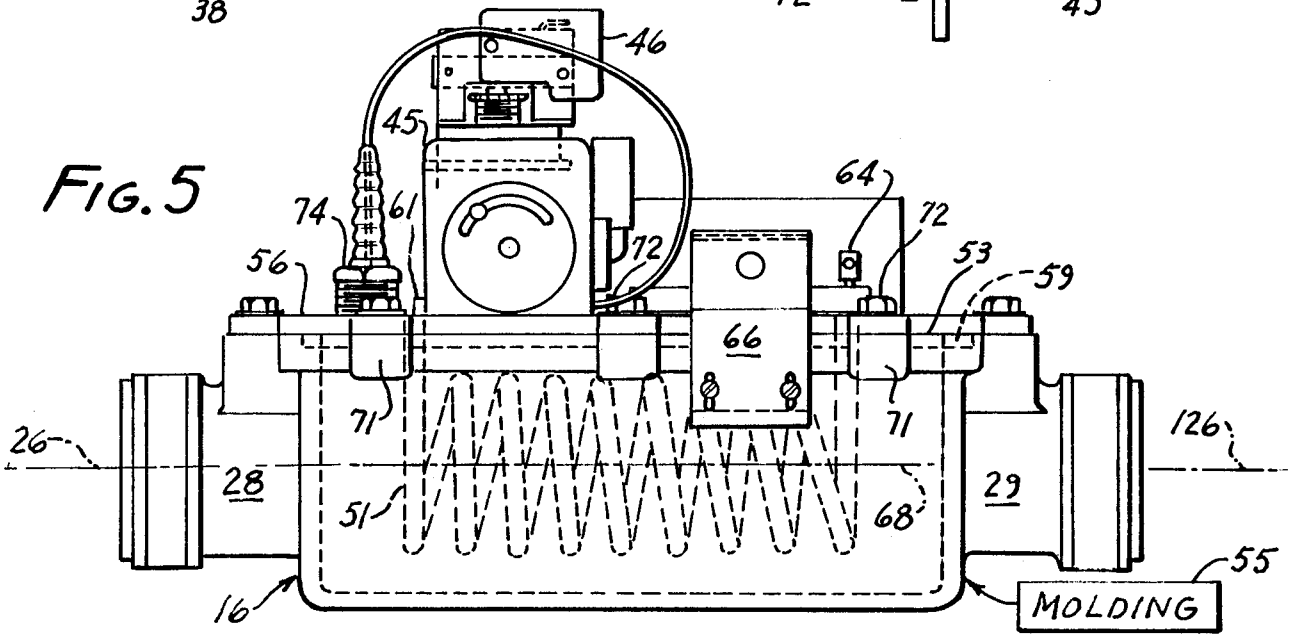
FIG. 5 is an elevation of the electric heater of FIG. 4.

As seen in FIGS. 2, 4 and 5, the elongate flow-through heater 16 or its elongate housing structure is provided at one end thereof with a water inlet 28 lying in the horizontal plane 26 and connected to a first part 18 of the piping. At the other end thereof, the elongate heater 16 is provided with a water outlet 29 lying in the horizontal plane 26 and connected to a second part 19 of the piping lying also in that horizontal plane.

The pump 15 is provided with a water outlet 31 lying in the horizontal plane and connected to the first part 18 of the piping lying also in that horizontal plane 26. In principle, pump, heater and filter may be exchanged among themselves in the horizontal plane 26, so that the pump outlet 31, broadly speaking, may be connected to either one of the first and second parts 18 and 19 of the piping lying in the horizontal plane 26.

Figure 3:
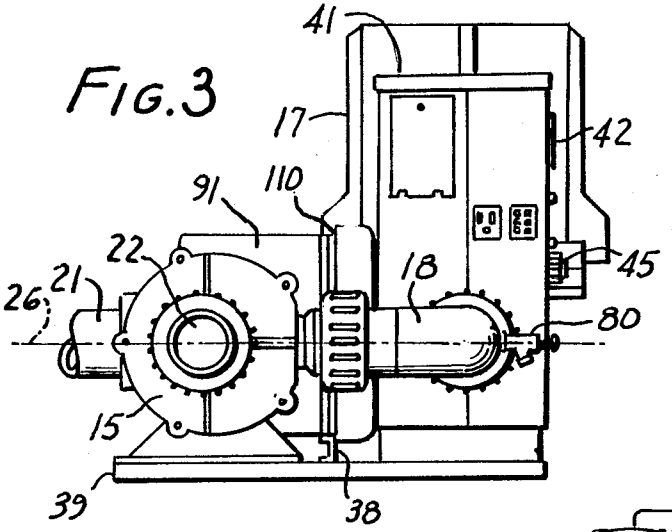
FIG. 3 is a side view of the assembly shown in FIGS. 1 and 2.

According to the illustrated preferred embodiment seen in FIG. 1, the pump 15 is provided with an axis of rotation 33 lying also in the horizontal plane 26 shown in FIGS. 2 and 3. As specifically shown in FIGS. 1 and 2, the pump 15 is provided with an electric drive motor 35 extending also in the horizontal plane 26.

The pump 15 may, for instance, be a centrifugal pump, but other pump types are also within the scope of the subject invention.

In addition to the outlet 31, the pump 15 in the illustrated preferred embodiment of the invention also has its inlet 22 lying in the horizontal plane 26.

In the illustrated preferred embodiment, the filter is provided with inlet and outlet passages 20 and 24, connected to one of the first and second parts 18 and 19, such as the part 19 shown in FIGS. 1 and 2, of the piping lying in the horizontal plane 26. The filter 17 itself may be arranged laterally of the horizontal plane 26 and may be supported by feet or brackets (not shown) which support also the piping 19 and 24 relative to a floor or base 39.

The illustrated preferred embodiment shown in FIGS. 1 to 3 provides a vertical box 41 for housing the elongate flow-through heater 16 and for housing controls 42 to 46 for the electric flow-through heater and for the pump 15. The elongate flow-through heater is extended through a bottom region of the vertical box 41, as shown in dotted outline at 16 in FIG. 2, and the controls 42 to 46 are mounted above the elongate flow-through heater in the vertical box.

In this manner, condensation inside the box 41 may be minimized and users are shielded from direct heater contact.

The aspect of the invention concerned with the heating element 16 disposed in a horizontal plane 26 as shown in dotted outlines in FIG. 2, or as disposed along any predetermined plane for arrangements other than as shown in FIGS. 1 to 3, has an electric heating element 51, shown in dotted outline in FIG. 5, for heating water in that elongate flow-through heater 16.

The currently discussed aspect of the invention also provides an elongate housing structure 52 extending along the horizontal plane 26 or other predetermined plane 126 which may be vertical or at any other angle, as dictated or desired by a given application other than the one shown in FIGS. 1 to 3.

The elongate housing structure 52 extends along the plane 26 or 126 for encompassing the electric heating element 51, and has a lateral opening 53 extending in parallel to the plane 26 or 126 for receiving the electric heating element therethrough. As seen in FIGS. 2, 4 and 5, the heater housing structure is trough-like and its lateral opening 53 extends like the internal cavity of the housing structure from the water inlet 28 to the water outlet 29, as does the metal plate 56 covering such internal cavity and lateral opening 53.

According to a preferred embodiment of the subject invention, thermal losses and corrodibility are reduced by molding the elongate housing structure 52 of an electrically insulating corrosion-resistant synthetic resin, as symbollically indicated at 55 in FIG. 5. In practice, electrically insulating resins are also thermally insulating so that heat cannot readily escape from the water pumped through, and heated in, the elongate heater 16, and so that users and others cannot get hurt by hot surfaces of the lateral housing structure 52, even if the heater is used without a protective box; such as the box 41 shown in FIGS. 1 to 3.

A metal plate 56 extending from the water inlet 28 to the water outlet 29 is provided in parallel to the horizontal or predetermined plane 26 or 126 as both a base for the electrical heating element 51 and as an electrical conductive complement of the electrically insulating elongate housing structure 52. In this manner, electrical leakage and fault currents can safely be diverted away from the water being pumped through, and heated in, the elongate flowthrough heater 16, without requiring the housing structure 52 to be of an electrically conductive material throughout its thickness. As symbolically indicated at 57 in FIG. 4, the metal plate or cover 56 may be grounded to divert leakage and fault currents away from the elongate heater 16 and from the water into which the electrical heating element 51 is immersed.

The lateral elongate opening 53 of the housing structure 52 is closed by sealing the metal plate 56 to the elongate housing structure over that lateral opening in parallel to the plane 26 or 126, while mounting the electric heating element 51 with that metal plate 56 in the housing structure 52 extending along that plane 26 or 126. A sealing gasket 59 may be employed for that purpose, partially in a corresponding groove extending along a top side of a corresponding flange of the elongate housing structure 52.

The heating element 51 is mounted on the metal plate near the water inlet 28, and is also mounted on that metal plate 56 near the opposite water outlet 29 of the elongate housing structure 52 or flow-through heater 16. Mounting bushings 61 and 62 may be employed for that purpose and may, for instance, be threaded through corresponding tapped holes in the metal plate 56 below the electrical terminals 63 and 64 through which the electric heating element 51 is connected to a source of electric power via temperature control and switching means, which may be of a conventional type, such as symbolically indicated at 42, 44, 45 and 66 in FIGS. 4 and 5.

According to the illustrated preferred embodiment of the subject invention, the heating element 51 is wound in the form of a helix having a longitudinal axis 68 extending along, or lying in, the horizontal or predetermined plane 26 or 126. In principle it would be within the scope of the subject invention to use a cantilevered or other heating structure in the elongate housing 52. However, in order to avoid stress fatigue and increase the reliability of the heater, a helical heating structure having a first end mounted at 61 on the metal plate 56 near the water inlet 28, and having an opposite second end mounted at 62 on the metal plate 56 near an opposite water outlet 29 of the elongate housing structure 52, is presently preferred.

The elongate housing structure 52 is provided with bosses 71 for receiving bolts or other fasteners 72 for attaching the metal plate 56 to the housing structure 52, as shown in FIG. 5.

The metal plate 56 may also be used as a base for controls 45, 66 and 74 for the electric heating element 51. By way of example, these controls may include a temperature controller 45, a manual reset high temperature limit switch or thermostat 66, and a bushing 74 extending through a well.

In FIG. 2, the elongate flow-through heater 16 is shown as extending through a bottom region 76 of the vertical box 41. While that arrangement is indeed preferred in the context of the embodiment of FIGS. 1 to 3, other arrangements of flow-through heater 16 and box 41 are also within the scope of the subject invention.

By way of example, another embodiment of the invention may also have a box, such as the box 41, for housing the elongate flow-through heater 16, and for housing controls 42, 44, 45, etc. for the electric heating element. The elongate housing structure 52 or flow-through heater 16 may again be mounted in only part of an amount of space occupied by the box 41 which, however, need not be the bottom region, as in FIG. 2. At least part of the controls 42, etc., may then be mounted in a remainder of the space occupied by the box 41. Predetermined ones of the controls, such as the above mentioned controls 45, 66 and 74, may again be mounted on the metal plate 56 in the box 41 in addition to the electric heating element 51.

The controls herein contemplated may also include parts or components outside the heater and control box 41. For instance, a flow switch (not shown) may be arranged in and at the horizontal piping 19, as shown by way of example in FIGS. 1 and 2. In this respect, as their names imply, a flow switch detects water flow, while a pressure switch would detect water pressure, in the heater 16 or outlet piping 19. Such a flow switch may replace the pressure switch 46.

Either switch may thus be combined with the remaining controls to make sure that the heater 51 is not energized when insufficient water, or no water at all, flows therethrough.

While the filter 17 in the embodiment illustrated in FIGS. 1 to 3 is mounted above the horizontal plane 26, the filter inlets and outlets 20 and 24, respectively, as well as a controllable or controlled filter bypass 79, extend also in the horizontal plane 26 and preferably have water flow passages extending in that plane.

The pump inlet and outlet 22 and 31, the heater inlet and outlet 28 and 29 and the filter inlet and outlet 36 and 24 may be externally threaded, so as to receive internally threaded nuts or connecting devices 81 to 85 for connecting such inlets and outlets to piping or pipes 21, 18, 19, and 24, respectively.

If jet action of water flowing into the tub 12 is desired, the pump 15 is driven at high speed and the resulting water pressure opens the filter bypass valve 79 whereby water flows directly from inlet 20 to outlet 24. On the other hand, the valve 79 closes, and remains closed during normal water motion, whereby hot water flows through the filter material 37 on its way to the tub 12.

An outlet faucet or spigot 80 may be provided in the piping 18 for attachment of a garden hose for convenient drainage of the tub 12 or water 13.

The subject invention, from one aspect thereof, also resides in a system for supplying a tub with hot water through a water circulation system including a flow-through heater, such as the heater 16, and including apparatus 91 shown in FIGS. 1 to 3 and 6, for injecting air bubbles into the hot water in the tub. That system according to the currently discussed aspect of the invention is shown separately in FIG. 6, inasmuch as it may in practice be used in combination with other water heating and circulating systems, than the ones so far disclosed herein.

Figure 6:
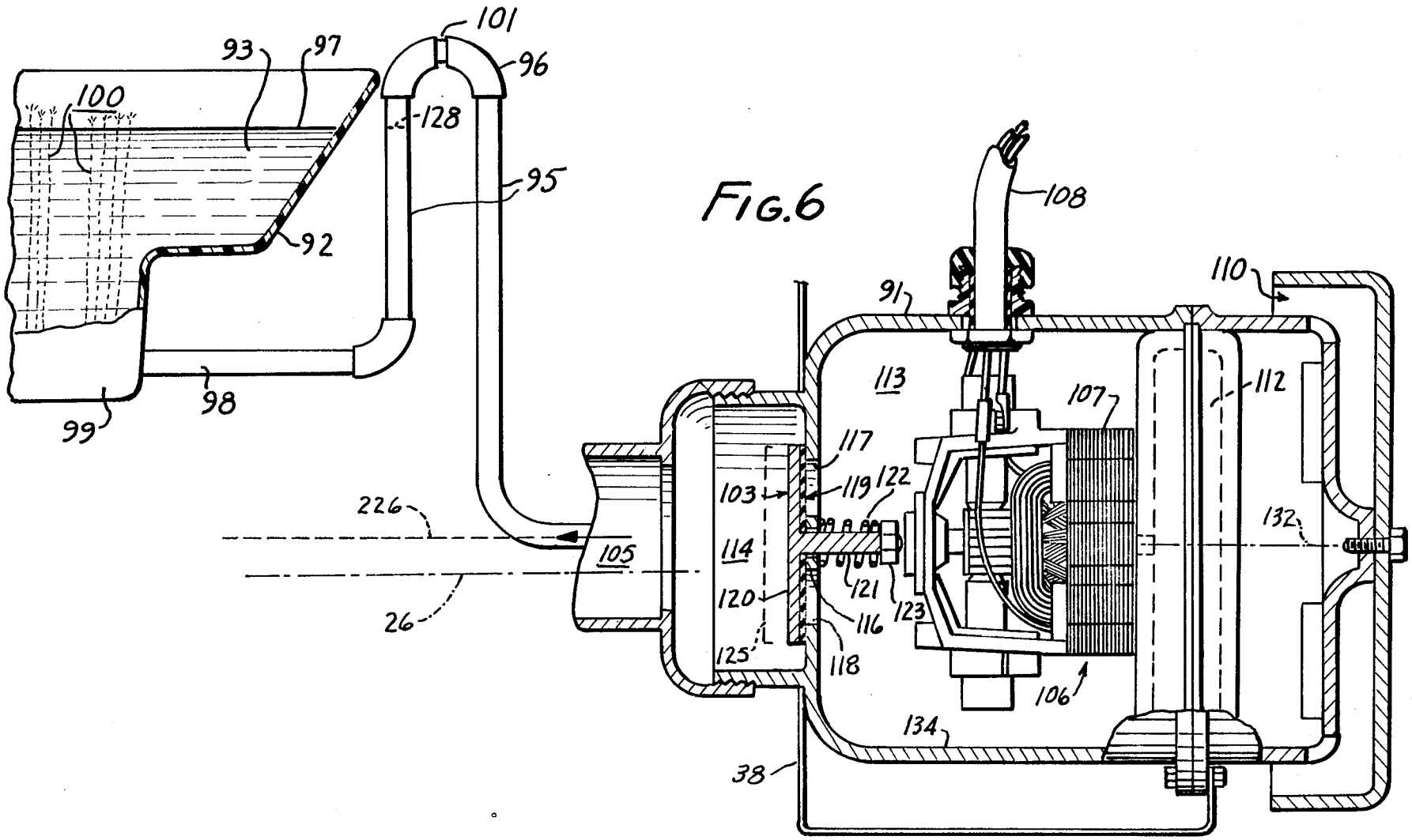
FIG. 6 is a section, taken on the line 6—6 in FIG. 1 and shown on an enlarged scale, of an air blower apparatus according to an embodiment of the invention, for creating streams of air bubbles in a spa and tub, as diagramatically illustrated in FIG. 6 and as also indicated in FIG. 2, with the showing of the tub in FIG. 6 being offset relative to the showing of the tub in FIG. 2 for simplicity of illustration.

In this respect, the tub 12 and the hot water 13 may or may not be the same as the tub 92 and water 93 shown in FIG. 6 on a reduced scale relative to the air bubble injecting apparatus 91.

By way of general background, the apparatus 91 is connected to the tub 92 through an air piping or loop 95 which, at 96, extends above the water level 97 in the tub 92, as generally required in this kind of installation, mainly for anti-syphon purposes.

The loop or air piping 95 has an outlet 98 extending into a bottom region 99 of the tub 92 for injecting air bubbles 100 into the water 93 for a therapeutic effect on the occupant of the tub. The design of the tub bottom region 99 may be conventional and may, for instance, include a false bottom having apertures therethrough (not shown) for distributing throughout the tub 92 such air as is received from the outlet 98 below the apertured false bottom in the tub. Of course, further conventional or other means may be employed in or at the tub for distributing the air received through the outlet 98 in any desired manner for any desired effect. It would even be possible in this respect to inject the air into the hot water pumped in the feedline 23.

The loop or piping 95 shown in FIG. 6 has a horizontal piece of pipe or conduit 101 at a point where a conventional air pipe loop would have the traditional anti-syphon valve.

Contrarywise, and in accordance with the aspect of the invention shown in FIG. 6, the anti-syphon valve 103 of the system is located in the apparatus 91 ahead of its outlet 105 which in practice may be part of the piping 95.

In particular, the illustrated air injecting apparatus 91 includes an air blower 106 of which an electric motor 107 energized through a cable 108 is visible in FIG. 6.

The apparatus 91 has an annular air inlet 110 through which air is drawn by the blower or turbine wheel 112 shown only in dotted outline, but driven by the motor 107.

The blower or apparatus 91 has a pumping chamber 113 and an outlet chamber 114 ahead of the air blower outlet 105 or air piping 95.

In general terms, where the currently disclosed aspect of the invention resides in a system for injecting air bubbles 100 into water 97 located in a tub 92 through air piping 95, the air blower 91 or 106 has an air outlet 105 connected to that air piping 95, and an anti-syphon valve 103 in the air blower ahead of that air outlet 105 connected to the air piping.

In the preferred embodiment shown in FIG. 6, the anti-syphon valve 103 is positioned inside the apparatus 91, such as inside of the blower outlet chamber 114.

The anti-syphon valve 103 is mounted on a part 116 of an inner section of the blower housing below the outlet chamber 114. In the illustrated embodiment, the valve mounting part 116 is located between a pair of outlet holes 117 and 118 covered by a gasket 119 of the valve 103.

The gasket 119 is attached to a lower surface of the valve poppet or plate 120 which also carries the valve stem 121. The valve spring 122 encompasses the stem 121 and acts between the stationary valve support 116 and the valve retainer 123 attached to the free end of the axially moveable valve stem 121.

The blower motor 107 may be energized from one of the controls shown at 42 to 44 in FIG. 2, or may have its own electric switch or control.

The valve spring 122 maintains the valve 103 normally closed, by sealing the inner inlet openings 117 and 118 with the valve gasket 119. On the other hand, when energized, the blower 106 draws outside air through the inlet opening 110 into the blower chamber 113 and forces such compressed air through the inner outlet openings 117 and 118 against the gasket 119, thereby lifting the valve against the bias of its spring 122 off its valve seat to an open position, as indicated by a dotted line 125.

Air compressed by the blower 106 now flows through the inner outlet openings 117 and 118 into the outlet chamber 114 and thence through the blower outlet 105, piping or loop 95 and loop outlet 98 into the bottom part 99 of the tub or pool 92, providing streams of air bubbles 100 rising upwardly through the water 93.

When the energization of the blower motor 107 stops, any pressurized air present in the blower chamber 113 readily escapes through the inlet opening or openings 110, whereby the valve spring 122 is again enabled to move the valve from its open position, shown by a dotted line 125, to its solidly illustrated closed position, thereby sealing with its gasket 119 the inner air outlet openings 117 and 118. In this manner, the blower chamber 113 is automatically sealed off from the outlet chamber 114 and thereby from the loop or piping 95, when energization of the blower motor and thereby active operation of the blower stops for any reason.

In consequence, no water from the pool or tub 92 can syphon through the piping 95 into the blower chamber 113. To the contrary, since the spring 122 closes the valve 103 as soon as pressure drops in the blower chamber 113, there will be sufficient air left in the outlet chamber 114 and part of the piping 95 from the blower outlet 105 through the horizontal section 101 for maintenance of the water level in the remainder of the piping 95 at a level indicated by a dotted line 128, which adequately corresponds to the level of the water 93 in the pool or tub 92.

Any water that may, nevertheless spill into the blower outlet chamber 114 is kept away from the blower chamber 113 by the closed valve 103, and may readily be entrained by air flowing through the outlet chamber 114 when the motor 107 is reenergized. Also, a removable drain plug (not shown) may be provided as a draining device for that purpose.

The preferred embodiment of the invention shown in FIGS. 1 to 3 and 6 provides apparatus 91 for blowing air into the hot water 13 or 93 and mounts such apparatus, such as by means of a bracket 38 or similar base, in the horizontal plane 26. In principle, the air blowing apparatus 91 may be vertical and still be in the horizontal plane 26. However, the apparatus 91 preferably is arranged horizontally as shown in FIG. 6, whereby any water accidentally spilling through aperture 118 comes to rest on the horizontally arranged side 134 of the apparatus 91, rather than dropping down onto the electric motor 107.

In the preferred embodiment, the apparatus 91 is provided with an air blower 106 having an axis of rotation 132 extending parallel to the horizontal plane 26, as shown in FIG. 6. The expression "parallel" thereby is intended to be broad enough to include also "coincident," since by appropriate dimensioning of the apparatus and/or mounting bracket 38, the blower axis of rotation 132 may be brought to lie in the horizontal plane, shown in FIG. 6 by a dotted line 226 for that purpose. In other words, while 26 in FIGS. 1 to 3, 5 and 6 shows the horizontal plane in which the axis of rotation 33 of the pump 15 and pump motor 35, the heater 16, the piping 18, 19 and 21, the filter inlet 20 and outlet 24, and the box 41 are located, and to which the blower axis of rotation 132 is parallel, the dotted line 226 indicates, on the other hand, that the latter components may be located in a horizontal plane 226 in which the blower axis of rotation 132 lies, with "parallel" in this case meaning also "coincident."

The subject extensive disclosure will render apparent or suggest to those skilled in the art various modifications and variations within the spirit and scope of the subject invention and equivalents thereof.

I/We claim:

1. In a method of providing a water heating system including an elongate electric flow-through heater, the improvement comprising in combination the steps of:

providing an electric heating element for heating water in said elongate flow-through heater;

providing an elongate housing structure extending along a predetermined plane for encompassing said electric heating element, said elongate housing structure being provided at one end thereof with a water inlet lying in said horizontal plane and connected to a first part of said piping, and at the other end thereof with a water outlet lying in said horizontal plane and connected to a second part of said piping, and having a lateral opening extending from said water inlet to said water outlet in parallel to said predetermined plane for receiving said electric heating element therethrough;

reducing thermal losses and corrodibility by molding said elongate housing structure of an electrically insulating corrosion-resistant synthetic resin;

providing a metal plate extending from said water inlet to said water outlet in parallel to said predetermined plane as both a base for said electric heating element and as an electrically conductive complement of said electrically insulating elongate housing structure; and closing said laterally opening by sealing said metal plate to said elongate housing structure over said lateral opening in parallel to said predetermined plane while mounting said electric heating element with said metal plate in said housing structure extending along said predetermined plane.

2. A method as claimed in claim 1, wherein:

said heating element is mounted on said metal plate near a water inlet of said elongate housing structure and is also mounted on said metal plate near an opposite water outlet of said elongate housing structure.

3. A method as claimed in claim 1, wherein:

said heating element is wound in the form of a helix having a longitudinal axis along said predetermined plane and having a first end mounted on said metal plate near a water inlet of said elongate housing structure and an opposite second end mounted on said metal plate near an opposite water outlet of said elongate housing structure.

4. A method as claimed in claim 1, wherein:

said elongate housing structure is provided with bosses for receiving fasteners for attaching said metal plate to said housing structure.

5. A method as claimed in claim 1, including the step of:

using said metal plate also as a base for controls for said electric heating element.

6. In a system for heating water in an elongate electric flow-through heater, the improvement comprising in combination:

an electric heating element for heating water in said elongate flow-through heater;

an elongate housing structure consisting of a molded electrically insulating corrosion-resistant synthetic resin, extending along a predetermined plane, encompassing said electric heating element and having at one end thereof a water inlet lying in said predetermined plane and connected to a first part of said piping, and at the other end thereof a water outlet lying in said horizontal plane and connected to a second part of said piping, said elongate housing structure having a lateral opening extending from said water inlet to said water outlet in parallel to said predetermined plane for receiving said electric heating element therethrough; and means for providing both a base for said electric heating element and an electrically conductive complement of said elongate housing structure, comprising a metal plate mounted over said lateral opening extending from said water inlet to said water outlet and sealed to said elongate housing structure in parallel to said predetermined plane.

7. A system as claimed in claim 6, including;

means for mounting said heating element on said metal plate near a water inlet of said elongate housing structure; and means for mounting said heating element also on said metal plate near an opposite water outlet of said elongate housing structure.

8. A system as claimed in claim 6, wherein:

said heating element is in the form of a helix having a longitudinal axis along said predetermined plane and having a first end mounted on said metal plate near a water inlet of said elongate housing structure and an opposite second end mounted on said metal plate near an opposite water outlet of said elongate housing structure.

9. A system as claimed in claim 6, including:

means for receiving fasteners for attaching said metal plate to said housing structure, including bosses in said elongate housing structure.

10. A system as claimed in claim 6, including:

means for mounting controls for said electric heating element on said metal plate.

11. A system as claimed in claim 6, including:

a box for housing said elongate flow-through heater and for housing controls for said electric heating element:

means for mounting said elongate housing structure in only part of an amount of space occupied by said box; and means for mounting at least part of said controls in a remainder of said space.

12. A system as claimed in claim 11, wherein:

said means for mounting said controls include means for mounting predetermined ones of said controls on said metal plate in said box in addition to said electric heating element.

* * * * *